US006598961B2

(12) United States Patent
Kuk et al.

(10) Patent No.: US 6,598,961 B2
(45) Date of Patent: Jul. 29, 2003

(54) BUBBLE-JET TYPE INK-JET PRINTHEAD

(75) Inventors: Keon Kuk, Yongin (KR); Doo-jin Maeng, Seoul (KR); Yong-soo Oh, Seongnam (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/995,762

(22) Filed: Nov. 29, 2001

(65) Prior Publication Data

US 2002/0067396 A1 Jun. 6, 2002

(30) Foreign Application Priority Data

Dec. 5, 2000 (KR) ..... 2000-73481

(51) Int. Cl.[7] ..... B41S 2/05
(52) U.S. Cl. ..... 347/63; 347/64; 347/65
(58) Field of Search ..... 347/63, 64, 65, 347/21, 56, 94

(56) References Cited

U.S. PATENT DOCUMENTS 4,720,716 A * 1/1988 Ikeda et al. ..... 347/64
6,183,067 B1 * 2/2001 Matta ..... 347/65

FOREIGN PATENT DOCUMENTS

| | | |
|---|---|---|
| EP | 0244214 | 11/1987 |
| JP | 62094347 | 4/1987 |
| JP | 4257450 | 9/1992 |
| JP | 10-202915 | 8/1998 |

* cited by examiner

*Primary Examiner*—John Barlow
*Assistant Examiner*—Michael S Brooke
(74) *Attorney, Agent, or Firm*—Lee & Sterba, P.C.

(57) ABSTRACT

A bubble-jet type ink-jet printhead, includes a substrate, a nozzle plate, a wall, and a heater, wherein the heater is interposed between the substrate and the nozzle plate to divide an ink chamber into a main ink chamber and a secondary ink chamber, wherein a main bubble and a secondary bubble are generated. The printhead may further include an ink channel for introducing ink into the secondary ink chamber for supplying the ink to the main ink chamber. The printhead according to the present invention consumes less energy, prevents a backflow of ink, and operates at increased speed.

14 Claims, 5 Drawing Sheets

BUBBLE-JET TYPE INK-JET PRINTHEAD

BACKGROUND OF THE INVENTION

1. Field of the Invention

The present invention relates to an ink-jet printhead. More particularly, the present invention relates to a bubble-jet type ink-jet printhead.

2. Description of the Related Art

Ink-jet printing heads are devices for printing a predetermined color image by ejecting a small droplet of printing ink at a desired position on a recording sheet. Ink ejection mechanisms of an ink-jet printer are generally categorized into two types: an electro-thermal transducer type (bubble-jet type), in which a heat source is employed to form a bubble in ink causing an ink droplet to be ejected, and an electro-mechanical transducer type, in which a piezoelectric crystal bends to change the volume of ink causing an ink droplet to be expelled.

Referring to FIGS. 1A and 1B, a conventional bubble-jet type ink ejection mechanism will now be described. When a current pulse is applied to a heater 12 consisting of resistive heating elements formed in an ink channel 10 where a nozzle 11 is located, heat generated by the heater 12 boils ink 14 to form a bubble 15 within the ink channel 10, which causes an ink droplet 14' to be ejected.

There are multiple factors and parameters to consider in making an ink-jet printhead having a bubble-jet type ink ejector. First, it should be simple to manufacture, have a low manufacturing cost, and be capable of being mass-produced. Second, in order to produce high quality color images, the formation of minute, undesirable satellite ink droplets that usually trail an ejected main ink droplet must be avoided. Third, when ink is ejected from one nozzle or when ink refills an ink chamber after ink ejection, cross-talk with adjacent nozzles, from which no ink is ejected, must also be avoided. To this end, a back flow of ink in a direction opposite to the direction ink is ejected from a nozzle must be prevented during ink ejection. For this purpose, a second heater 13 as shown in FIGS. 1A and 1B is typically provided to prevent a back flow of the ink 14. The second heater 13 generates heat sooner than the first heater 12, which causes a bubble 16 to shut off the ink channel 10 behind the first heater 12. Then, the first heater 12 generates heat, and the bubble 15 expands to cause the ink droplet 14' to be ejected. Fourth, for high-speed printing, a cycle beginning kit with ink ejection and ending with ink refill in the ink channel must be carried out in as short a period of time as possible. Fifth, a nozzle and an ink channel for introducing ink to the nozzle must not be clogged by a foreign material or by solidified ink.

The above requirements, however, tend to conflict with one another. Furthermore, the performance of an ink-jet printhead is closely associated with and affected by the structure and design of an ink chamber, an ink channel, and a heater, as well as by the type of formation and expansion of bubbles and the relative size of each component.

FIG. 2 illustrates a perspective, partial cutaway view of a conventional ink-jet printhead showing the internal structure of the ink-jet printhead, and FIG. 3 illustrates a cross-sectional view of the conventional printhead shown in FIG. 2, taken along the line I—I for explaining how an ink droplet is ejected from the printhead. Referring to FIG. 2, the ink-jet printhead includes a substrate 20, a wall 22 formed on the substrate 20 for providing an ink chamber 26 for containing ink, a heater 23 disposed in the ink chamber 26 for generating heat, and a nozzle plate 21 having an orifice 24 for ejecting an ink droplet. Ink is supplied to the ink chamber 26 through an ink channel 25 and to the orifice 24 in flow communication with the ink chamber 26 by capillary action.

Referring to FIG. 3, in this configuration, if current is applied to the heater 23, the heater 23 generates heat to form a bubble B in ink, thereby filling the ink chamber 26 as shown in FIG. 3. Then, the bubble B expands to exert pressure on the ink within the ink chamber 26 causing an ink droplet 28 to be ejected through the orifice 24.

However, in the ink-jet printhead having the structure described above, a considerable amount of heat generated by the heater 23 is transferred and absorbed into the substrate 20. It is desirable that the heat generated by the heater 23 be used to boil ink and form the bubble B. However, most of the heat is absorbed into the substrate 20, and only a small amount of the heat is actually used to form the bubble B. This means that the heat energy supplied to generate the bubble B is wasted in heating the substrate 20, thereby increasing energy consumption. Also, the ink-jet printhead has a problem in that the temperature of a head is significantly increased as a print cycle runs because the heat transferred to the substrate 20 in turn heats the head system. Furthermore, the heat flow into the substrate 20 causes the ink to be heated or cooled at a lower speed or cycle, thereby increasing the length of the cycle from formation to collapse of the bubble and thus decreasing print speed.

Typically, the amount of ink pushed away from a nozzle by a generated bubble is closely related to the print speed of an ink-jet printhead. In the ink-jet printhead having the conventional structure described above, the amount of ink that is pushed away from the orifice 24 is approximately the same as the amount of ink ejected by the bubble B, thereby making a print cycle longer and thus reducing the print speed of the printhead.

SUMMARY OF THE INVENTION

In an effort to solve the above problems, it is a feature of an embodiment of the present invention to provide a bubble-jet type ink-jet printhead configured so that a heater disposed within an ink chamber does not directly contact a substrate and further configured so that an ink channel is disposed inside the substrate thereby consuming less energy in operating the printhead, preventing a backflow of ink, and increasing the printing speed of the printhead.

Accordingly, the present invention provides a bubble-jet type ink-jet printhead including: a substrate; a nozzle plate separated from the substrate by a predetermined distance, the nozzle plate having an orifice for ejecting ink; a wall for closing the space between the substrate and the nozzle plate and for forming an ink chamber filled with ink therebetween; and a heater interposed between the substrate and the nozzle plate for dividing the ink chamber into a main ink chamber disposed above the heater and a secondary ink chamber disposed below the heater, the main ink chamber and the secondary ink chamber generating a main bubble and a secondary bubble, respectively, upon heating of the heater.

Preferably, a groove for forming the secondary ink chamber is formed in the substrate at a location corresponding to the heater. Additionally, it is preferable that the main ink chamber and the secondary ink chamber are in flow communication.

In another embodiment of the present invention, a bubble-jet type ink-jet printhead includes: a substrate; a nozzle plate separated from the substrate by a predetermined distance, the nozzle plate having an orifice for ejecting ink; a wall for closing the space between the substrate and the nozzle plate and for forming an ink chamber filled with ink therebetween; a heater interposed between the substrate and the nozzle plate for dividing the ink chamber into a main ink chamber disposed above the heater and a secondary ink chamber disposed below the heater, the main ink chamber and the secondary ink chamber generating a main bubble and a secondary bubble, respectively, upon heating of the heater and an ink channel connecting the secondary ink chamber to an ink reservoir so that ink is introduced into the secondary ink chamber and then supplied to the main ink chamber.

Preferably, a groove for forming the secondary ink chamber is formed in the substrate at a location corresponding to the heater. It is also preferable that the ink channel is formed at a location corresponding to the central portion of the heater by penetrating the bottom of the secondary ink chamber. Preferably, upper and lower passivation layers are formed above and below the heater, respectively. Also preferably, a portion of the lower passivation layer at a location corresponding to the ink channel is thinner than the upper passivation layer.

BRIEF DESCRIPTION OF THE DRAWINGS

The above features and advantages of the present invention will become readily apparent to those of ordinary skill in the art by describing in detail preferred embodiments thereof with reference to the attached drawings in which.

DETAILED DESCRIPTION OF THE INVENTION

Korean Patent Application No. 2000-73481, filed on Dec. 5, 2000, and entitled: "Bubble-jet Type Ink-Jet Printhead," is incorporated by reference herein in its entirety.

Figure 1A:
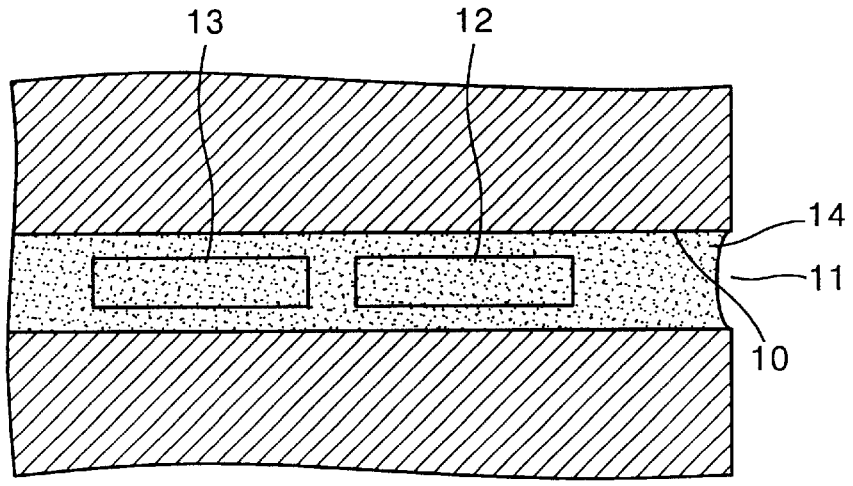
FIG. 1A (PRIOR ART)
FIGS. 1A and 1B illustrate cross-sectional views of a conventional bubble-jet type ink-jet printhead.
Figure 1B:
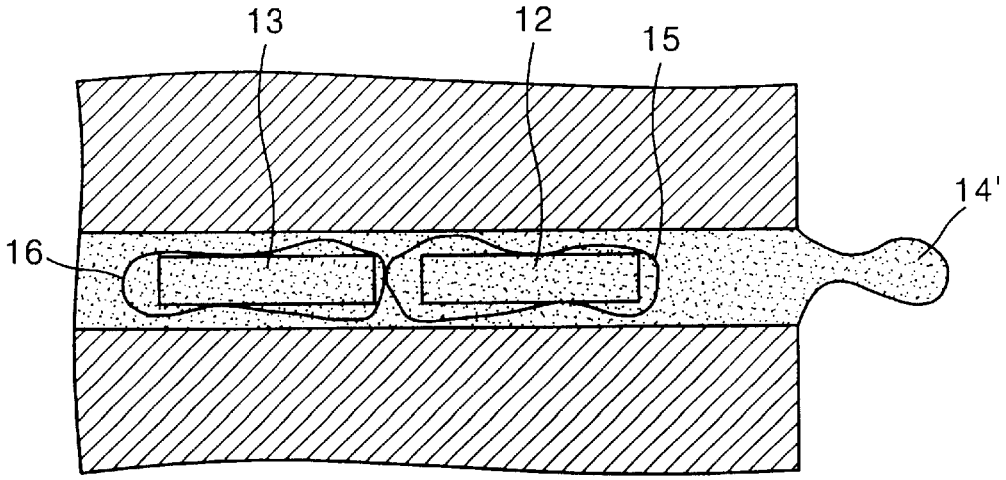
FIG. 1B (PRIOR ART)
Figure 2:
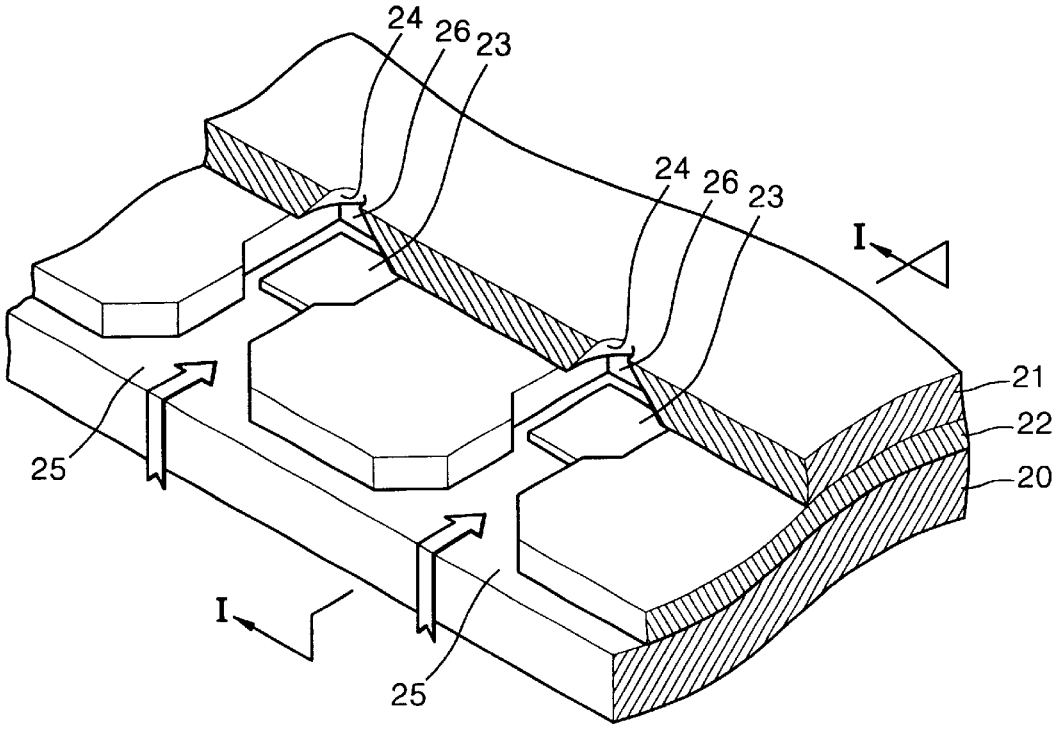
FIG. 2 (PRIOR ART)
FIG. 2 illustrates a perspective, partial cutaway view showing the internal structure of a conventional ink-jet printhead.
Figure 3:
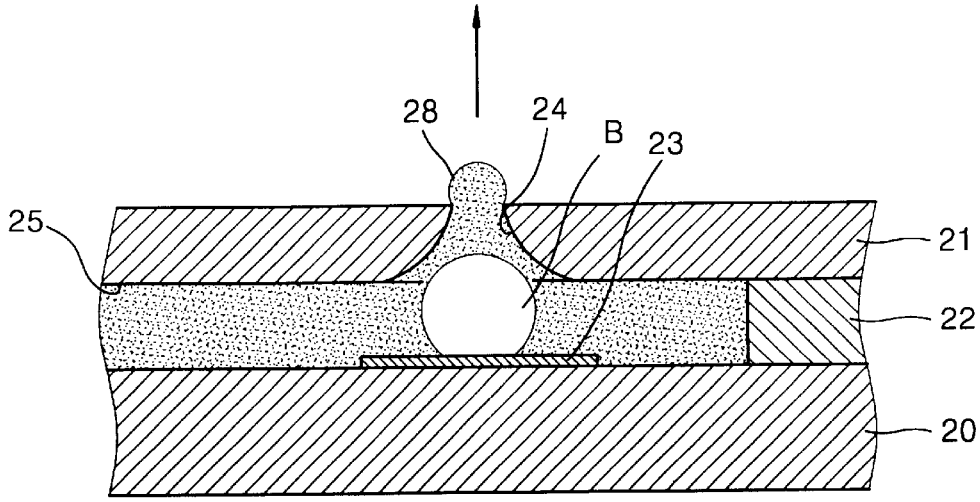
FIG. 3 (PRIOR ART)
FIG. 3 illustrates a cross-sectional view of a conventional bubble-jet type ink-jet printhead, showing the ejection of an ink droplet.
Figure 4:
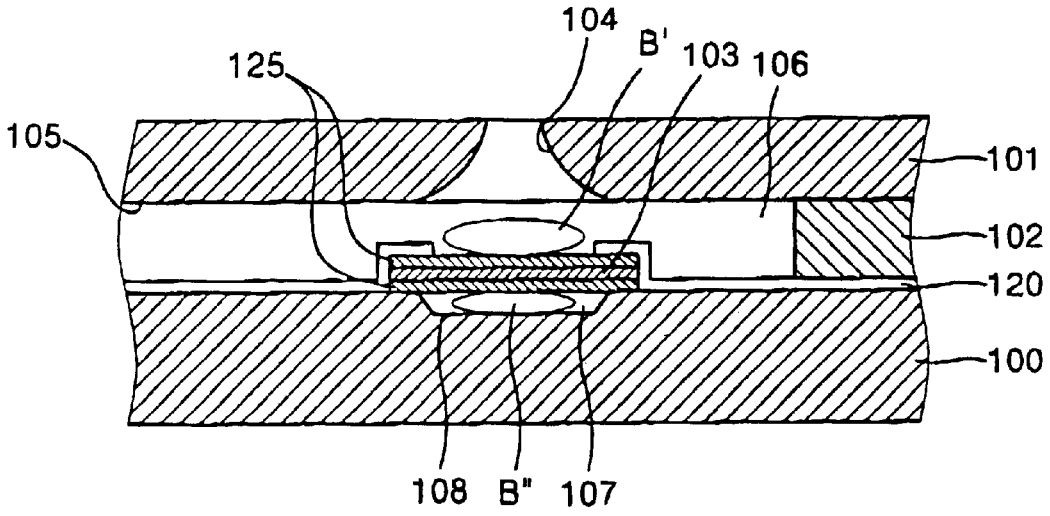
FIG. 4 illustrates a cross-sectional view of a bubble-jet type ink-jet printhead according to an embodiment of the present invention.
Figure 5:
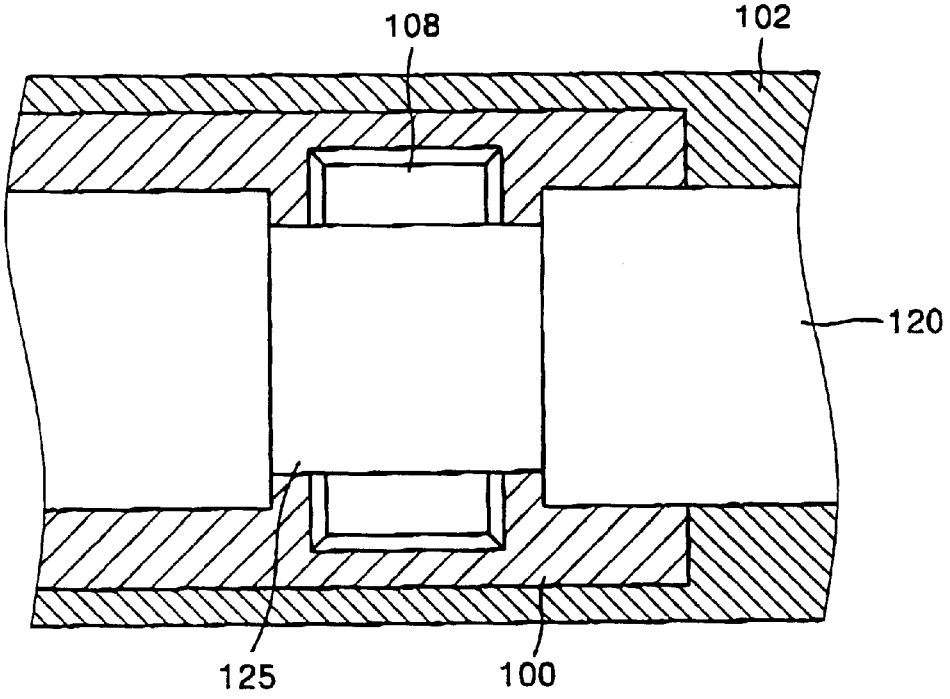
FIG. 5 illustrates a plan view showing the inside configuration of the printhead of FIG. 4.

Referring to FIGS. 4 and 5, a bubble-jet type ink-jet printhead according to a first embodiment of the present invention includes a substrate 100, a nozzle plate 101 separated from the substrate 100 by a predetermined distance, a wall 102 for forming an ink chamber to be filled with ink between the substrate 100 and the nozzle plate 101, and a heater 103 disposed in the ink chamber for generating heat. An orifice 104 for ejecting ink is formed in the nozzle plate 101, and ink is supplied to the ink chamber from an ink reservoir (not shown) through an ink channel 105. A rectangular groove 108 is formed in the substrate 100 at a position opposite the orifice 104, and the heater 103 is disposed on a portion of the substrate 100 where the rectangular groove 108 is formed. Thus, the ink chamber is divided into a main ink chamber 106 disposed above the heater 103 and a secondary ink chamber 107 disposed below the heater 103, or within the groove 108 on the substrate 100. As shown in FIGS. 4 and 5, the heater 103 is formed on the portion of the substrate 100 where the groove 108 is formed, and the main ink chamber 106 is in flow communication with the inside of the secondary ink chamber 107 so that the heater 103 is surrounded by ink filling the ink chambers 106 and 107. In this case, to prevent the ink within the ink chambers 106 and 107 from contacting the heater 103, passivation layers 125 are formed on the top and bottom of the heater 103. To heat the heater 103 by applying current, the heater 103 is connected to a conductor 120 through a through hole (not shown) formed in the passivation layer 125.

In this configuration, if current is supplied to the heater 103 through the conductor 120, the heater 103 generates heat to form a main bubble B' and a secondary bubble B" in the ink contained in the main ink chamber 106 and the secondary ink chamber 107, respectively, as shown in FIG. 4. The bubbles B' and B" expand to cause the ink to be ejected through the orifice 104 formed in the nozzle plate 101.

Thus, unlike the conventional art, the heater 103 is surrounded by the ink within the main ink chamber 106 and the secondary ink chamber 107, thereby transferring all of the heat generated by the heater 103 to the ink and thus generating the bubbles B' and B".

Although the embodiment has been described with respect to the rectangular groove 108, other shapes of the groove 108 are available provided that the secondary ink chamber 107 formed in the groove 108 operates as described above.

Figure 6:
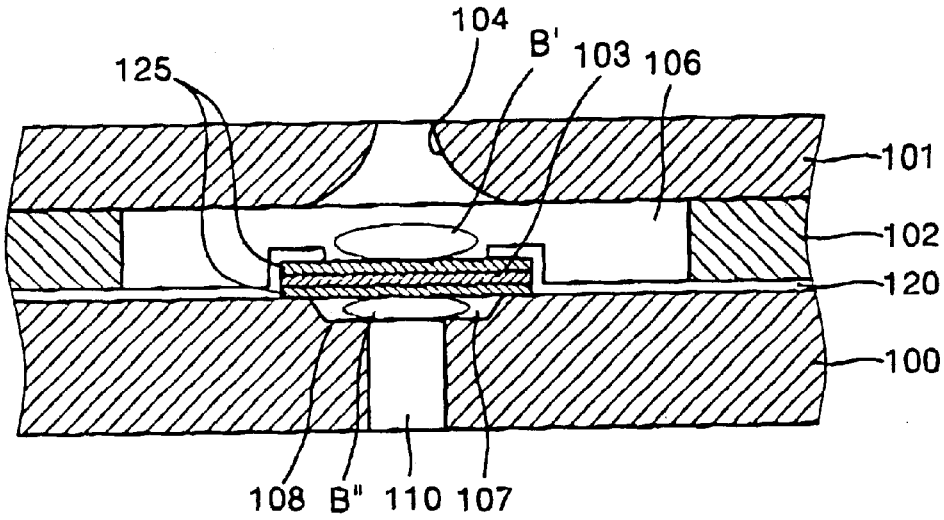
FIG. 6 illustrates a cross-sectional view of a bubble-jet type ink-jet printhead according to another embodiment of the present invention.
Figure 7:
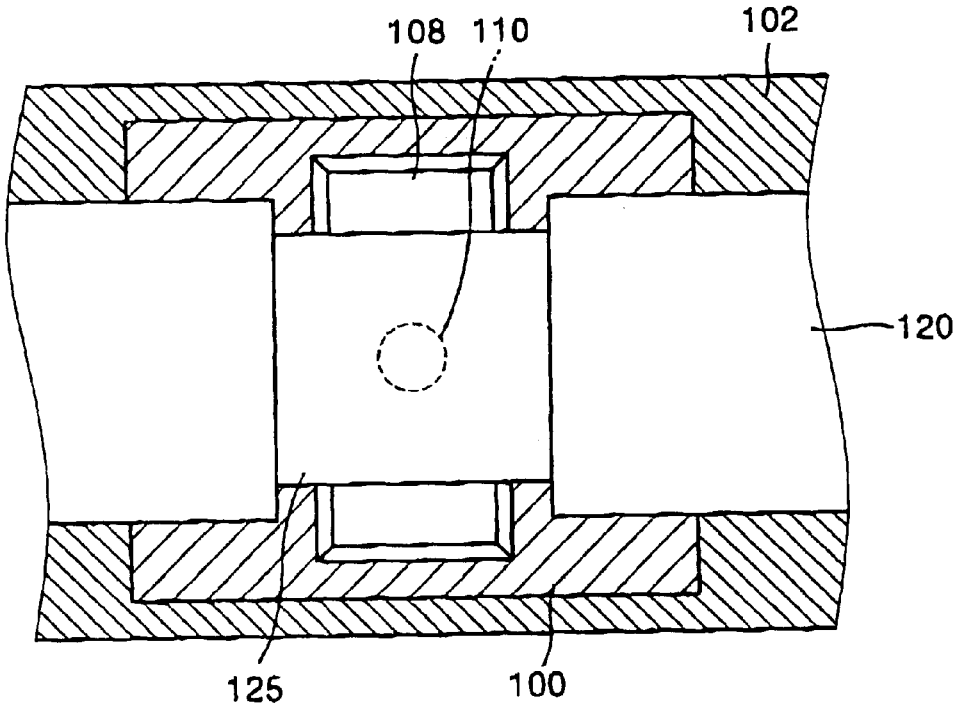
FIG. 7 illustrates a plan view showing the inside configuration of the printhead of FIG. 6.

FIGS. 6 and 7 show a bubble-jet type ink-jet printhead according to a second embodiment of the present invention. FIG. 6 illustrates a cross-sectional view of the ink-jet printhead according to this embodiment, and FIG. 7 illustrates a plan view showing the inside of the printhead of FIG. 6. Here, the same reference numerals as shown in FIGS. 4 and 5 denote the same members.

Referring to FIGS. 6 and 7, the bubble-jet type ink-jet printhead according to the second embodiment of the present invention includes a substrate 100, a nozzle plate 101, a wall 102, and a heater 103. Passivation layers 125 are formed on the top and bottom of the heater 103 and a conductor 120 for applying current is connected to the heater 103. A rectangular groove 108 is formed in the substrate 100 opposite an orifice 104 in the nozzle plate 101, and the heater 103 is disposed on the groove 108. A main ink chamber 106 and a secondary ink chamber 107 are formed above and below the heater 103, respectively, and both ink chambers 106 and 107 are in flow communication as shown in FIGS. 6 and 7. An ink channel 110 for introducing ink from an ink reservoir (not shown) into the secondary ink chamber 107 and then supplying the ink to the main ink chamber 106 is formed at a location corresponding to the central part of the substrate 103 by penetrating the bottom of the secondary ink chamber 107.

In this configuration, all of the heat generated by the heater 103 is transferred to the ink, thus generating a main bubble B' and a secondary bubble B" as described above. During ink ejection, the secondary bubble B" generated in the secondary ink chamber 107 blocks an inlet of the ink channel 110 penetrating the bottom of the secondary ink chamber 107, thereby preventing a backflow of ink. To effectively prevent a backflow of ink, both the shape or depth of the groove 108 forming the secondary ink chamber and the cross-section of the ink channel 110 need to be taken into account relative to the formation of the secondary bubble B" in order to provide complete blockage of the inlet of the ink channel 110.

As described above, although this embodiment has been described with respect to a rectangular groove 108, other shapes and configurations of the groove 108 are contemplated within the scope of this invention.

Figure 8:
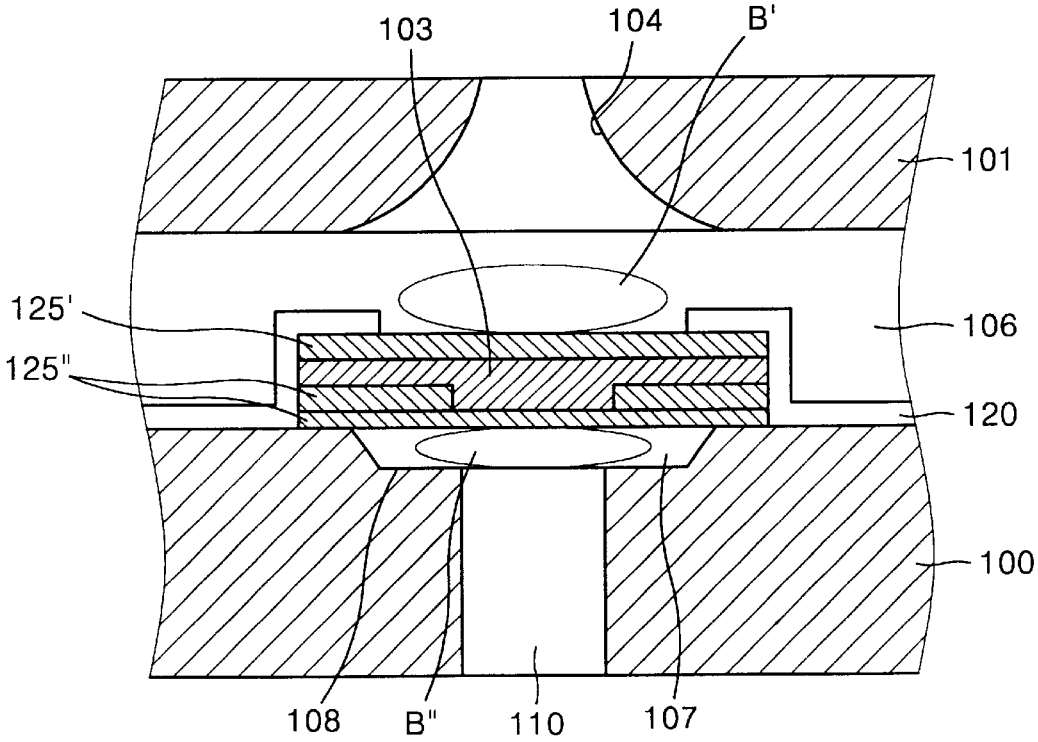
FIG. 8 illustrates a cross-sectional view of a bubble-jet type ink-jet printhead according to yet another embodiment of the present invention, showing a heater portion incorporating passivation layers having different thicknesses.

In order to more effectively prevent a backflow of ink, passivation layers 125 disposed at a main ink chamber side and a secondary ink chamber side of the heater 103 for insulation between ink and the heater 103 may have different thicknesses, and the passivation layer at the secondary ink chamber side may have a multilayer structure. FIG. 8 illustrates a cross-sectional view of a heater portion in which passivation layers of different thicknesses are provided.

Referring to FIG. 8, a portion of a lower passivation layer 125" disposed below the heater 103 at a location corresponding to the ink channel 110 is thinner than an upper passivation layer 125' disposed above the heater 103. Thus, heat generated by the heater 103 is transferred to ink filling the secondary ink chamber 107 faster than to that filling the main ink chamber 106, thereby generating the secondary bubble B" earlier than the main bubble B' is generated. The secondary bubble B" creates an air lock and blocks the ink channel 110 to effectively block any pressure generated by the main bubble B' from being transferred through the ink to the ink channel 110, and consequently prevents a backflow of ink. Furthermore, the printhead may be configured so that the lower passivation layer 125" has a multilayered construction. Moreover, only the portion of the lower passivation layer 125" at a location corresponding to the ink channel 110 may be made to be thinner, thereby generating a smaller secondary bubble B" in the secondary ink chamber 107 to effectively create an air lock and block the ink channel 110, and thereby preventing a backflow of ink.

In the above-described embodiments, the main ink chamber 106 and the secondary ink chamber 107 have been formed by disposing the heater 103 on the groove 108 formed in the substrate 100. Alternatively, a main ink chamber and a secondary ink chamber may be formed by simply interposing the heater 103 between the substrate 100 and the nozzle plate 101, with no groove 108 formed in the substrate 100.

As described above, a bubble-jet type ink-jet printhead according to the present invention is configured to have the heater 103 interposed between the substrate 100 and the nozzle plate 101, surrounded by ink, thus consuming less energy in operating the printhead by reducing heat loss from the heater 103 to the substrate 100, increasing the endurance of the printhead by reducing unnecessary heat accumulated in the substrate 100, and increasing the printing speed of the printhead due to quick cooling of the heater 103 after ink ejection. Furthermore, the ink channel 110 is provided below the heater 103, thereby preventing a backflow of ink during ink ejection and increasing the printing speed of the printhead.

While this invention has been particularly shown and described with reference to preferred embodiments thereof, it will be understood by those of ordinary skill in the art that various changes in form and details may be made herein without departing from the spirit and scope of the invention as defined by the appended claims.

What is claimed is:

1. A bubble-jet type ink-jet printhead comprising: a substrate; a nozzle plate separated from the substrate by a predetermined distance, the nozzle plate having an orifice for ejecting ink; a wall for closing the space between the substrate and the nozzle plate to form an ink chamber; and a heater interposed between the substrate and the nozzle plate for dividing the ink chamber into a main ink chamber disposed above the heater and a secondary ink chamber disposed below the heater, wherein a groove for forming the secondary ink chamber is formed in the substrate at a location corresponding to the heater, wherein the heater is wider than the groove and the heater is disposed on a portion of the substrate to bridge the groove formed in the substrate.

2. A bubble-jet type ink-jet printhead as claimed in claim 1, wherein the main ink chamber and the secondary ink chamber are in flow communication.

3. A bubble-jet type ink-jet printhead comprising: a substrate; a nozzle plate separated from the substrate by a predetermined distance, the nozzle plate having an orifice for ejecting ink; a wall for closing the space between the substrate and the nozzle plate to form an ink chamber, a heater interposed between the substrate and the nozzle plate for dividing the ink chamber into a main ink chamber disposed above the heater and a secondary ink chamber disposed below the heater, wherein a groove for forming the secondary ink chamber is formed in the substrate at a location corresponding to the heater, wherein the heater is wider than the groove and the heater is disposed on a portion of the substrate to bridge the groove formed in the substrate; and an ink channel connecting the secondary ink chamber to an ink supply, wherein the main ink chamber and the secondary ink chamber are in flow communication.

4. A bubble-jet type ink-jet printhead as claimed in claim 3, wherein the ink channel is formed at a location corresponding to the central portion of the heater by penetrating the bottom of the secondary ink chamber.

5. A bubble-jet type inkjet printhead as claimed in claim 4, further comprising an upper passivation layer formed on and above the heater and a lower passivation layer formed on and below the heater.

6. A bubble-jet type ink-jet printhead as claimed in claim 5, wherein the lower passivation layer is thinner than the upper passivation layer.

7. A bubble-jet type inkjet printhead as claimed in claim 5, wherein a portion of the lower passivation layer at a location corresponding to the ink channel is thinner than the upper passivation layer.

8. A bubble-jet type ink-jet printhead as claimed in claim 7, wherein the lower passivation layer comprises a plurality of passivation layers.

9. A bubble-jet type ink-jet printhead as claimed in claim 5, wherein the lower passivation layer comprises a plurality of passivation layers.

10. A bubble-jet type ink-jet printhead as claimed in claim 3, further comprising an upper passivation layer formed on and above the heater and a lower passivation layer formed on and below the heater.

11. A bubble-jet type ink-jet printhead as claimed in claim 10, wherein the lower passivation layer is thinner than the upper passivation layer.

12. A bubble-jet type ink-jet printhead as claimed in claim 10, wherein a portion of the lower passivation layer at a location corresponding to the ink channel is thinner than the upper passivation layer.

13. A bubble-jet type ink-jet printhead as claimed in claim 12, wherein the lower passivation layer comprises a plurality of passivation layers.

14. A bubble-jet type ink-jet printhead as claimed in claim 10, wherein the lower passivation layer comprises a plurality of passivation layers.

* * * * *